US006405997B1

(12) United States Patent
Granata

(10) Patent No.: US 6,405,997 B1
(45) Date of Patent: Jun. 18, 2002

(54) SCISSORS-TYPE VEHICLE LIFT

(75) Inventor: Tebaldo Granata, Treglio (IT)

(73) Assignee: Snap-on Deutschland Holding GmbH, Mettmann (DE)

( * ) Notice: Subject to any disclaimer, the term of this patent is extended or adjusted under 35 U.S.C. 154(b) by 0 days.

(21) Appl. No.: 09/807,593

(22) PCT Filed: Oct. 12, 1999

(86) PCT No.: PCT/IB99/01822

§ 371 (c)(1),
(2), (4) Date: Jul. 11, 2001

(87) PCT Pub. No.: WO00/21870

PCT Pub. Date: Apr. 20, 2000

(30) Foreign Application Priority Data

Oct. 15, 1998 (IT) ..... MI980674 U

(51) Int. Cl.[7] ..... B66F 3/22
(52) U.S. Cl. ..... 254/122

(58) Field of Search ..... 254/9 C, 122, 254/126, 124, 10 C

(56) References Cited

U.S. PATENT DOCUMENTS 3,034,765 A * 5/1962 Ludowici ..... 254/122
5,707,043 A * 1/1998 Yoshida ..... 254/126
6,276,489 B1 * 8/2001 Busuttil et al. ..... 182/69.1

* cited by examiner

*Primary Examiner*—Robert C. Watson
(74) *Attorney, Agent, or Firm*—Shook, Hardy & Bacon LLP

(57) ABSTRACT

A description is provided of a scissors-type vehicle lift (10), in which the arms (12–22) of the scissors have a transverse cross-section substantially in the shape of a "P", the cross-sections of the arms of adjacent pairs of arms being overturned relative to one another, such that when the scissors are closed, the said transverse cross-sections partially fit into one another.

3 Claims, 1 Drawing Sheet

SCISSORS-TYPE VEHICLE LIFT

TEXT OF THE DESCRIPTION

The present invention relates to scissors-type lifts. In the following description, scissors-type lifts mean in general scissors- and double-scissors-type lifts, in which, when the scissors are closed, the lift is lowered to ground level, and when the scissors are open, the lift is raised, and inverted- and double-inverted-scissors-type lifts, in which the scissors open beneath ground level, in order to lower the lift, and are closed at ground level in order to raise the lift, optionally with the assistance of pistons or rack-type mechanisms.

In the known scissors-type lifts, the arms have a flat shape. When the scissors are closed, the arms of each adjacent pair of arms are disposed parallel to one another. Although this arrangement of the arms is suitable for vertical loading or raising, it does not provide sufficient resistance to the lateral thrusts when the scissors are open.

The object of the present invention is thus to provide a scissors-type vehicle lift which withstands adequately both the vertical, or lifting load, and the lateral thrusts.

This problem is solved remarkably well by means of a scissors-type vehicle lift according to claim 1. Further advantageous characteristics of the said lift are described in the dependent claims.

The characteristics, objects and advantages of the present invention will become more apparent from the following description and from the attached drawings, relative to embodiments of a non-limiting nature. It will be appreciated that reference numbers which are the same in the various figures indicate parts which are the same or equivalent.

Figure 1:
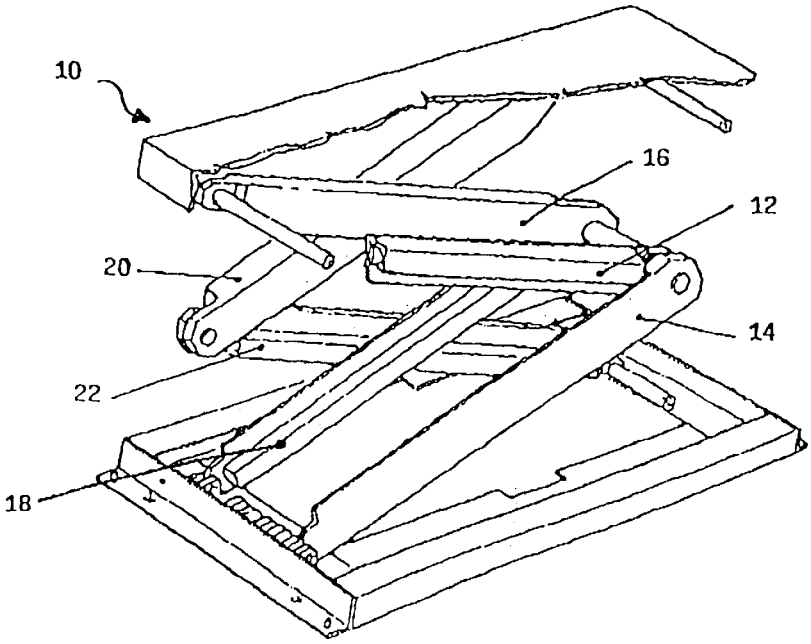
FIG. 1 is a schematic, partially cut-out view of a scissors-type lift according to the present invention.
Figure 4:
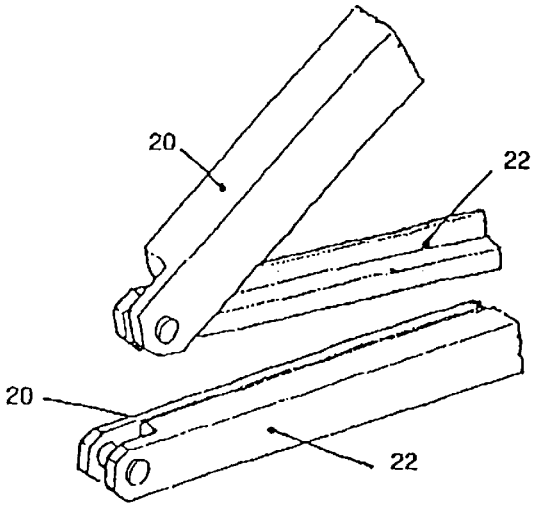
FIG. 4 is a perspective view of a pair of two scissor arms of the lift in FIG. 1, in the open position of the scissors and in the closed position.

With reference to the figures, a scissors-type vehicle lift 10 comprises a plurality of arms, of which only some are shown in FIG. 1, and are indicated by the reference numbers 12, 14, 16, 18, 20 and 22. According to the present invention, the arms 12–22 of the scissors have a transverse cross-section substantially in the shape of a "P", in which the leg of the "P" is thinner than a conventional flat iron arm, whereas the remainder of the "P" is thicker. The cross-sections of the adjacent pairs of arms are overturned relative to one another, such that, when the scissors are closed, as shown in the lower part of FIG. 4, the said transverse cross-sections partially fit into one another, and the two adjacent arms 20, 22 occupy a rectangular space with a dimension which substantially corresponds to that of a pair of arms of a lift according to the art prior to that of the present invention.

Figure 2:
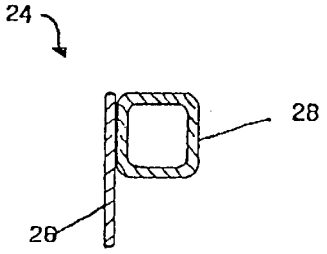
FIG. 2 is a view in cross-section of a first embodiment of a scissors-type arm according to the invention.

FIG. 2 illustrates a first embodiment of an arm 24, in which the transverse cross-section in the shape of a "P" is produced by means of a flat iron rib 26 and a box-shaped profiled section 28 which is fitted to the latter.

Figure 3:
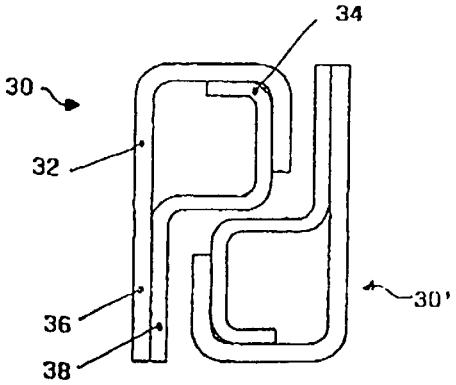
FIG. 3 is a schematic view in cross-section of a pair of two arms of scissors, according to a second embodiment of the invention.

FIG. 3 illustrates a second embodiment of an arm 30, in which the transverse cross-section in the shape of a "P" is produced by means of an outer profiled section 32 with two angles, and an inner profiled section 34 with three angles, two straight lengths 36 and 38 of the profiled sections 32, 34 fitting together in order to form the leg of the "P" of the arm 30. This figure also shows the connection of two arms 30, 30', such that the transverse cross-sections partially fit into one another.

Persons skilled in the art will appreciate that the arrangement of the arms according to the invention provides a vehicle lift which can withstand vertical, or lifting loads, and also lateral thrusts, in a manner which is substantially improved relative to the known lifts. Although the embodiments described include substantially hollow and square transverse cross-sections of the arms, it is apparent that solid arms or arms with a more rounded shape come within the scope of the modifications, adaptations, completions, variants and replacements included in the invention, as determined by the following, attached claims.

What is claimed is:

1. Scissors-type vehicle lift (10), characterised in that the arms (12–22; 24; 30) of the scissors have a transverse cross-section substantially in the shape of a "P", the cross-sections of the arms of adjacent pairs of arms (12, 14; 16, 18; 20, 22; 30, 30') being overturned relative to one another, such that when the scissors are closed, the said transverse cross-sections partially fit into one another.

2. Lift according to claim 1, characterised in that the said transverse cross-sections of the said arms (24) are produced by means of a flat rib (26) and a box-shaped profiled section (28).

3. Lift according to claim 1, characterised in that the said transverse cross-sections of the said arms (30) are produced by means of an outer profiled section (32) with two angles, and an inner profiled section (34) with three angles, two straight lengths (36; 38) of the profiled sections fitting together in order to form the leg of the "P" of the respective arm (30).

* * * * *